United States Patent [19]

Jaskiewicz

[11] Patent Number: 5,060,318

[45] Date of Patent: Oct. 29, 1991

[54] ASSEMBLY FOR AUTOMATICALLY CLOSING A WATER CLOSET COVER IN A CONTROLLED MANNER

[76] Inventor: Andrzej Jaskiewicz, 92 Daen Ave. #7, Smithfield, R.I. 02917

[21] Appl. No.: 503,891

[22] Filed: Apr. 4, 1990

[51] Int. Cl.[5] ..... A47K 13/10; A47K 13/04

[52] U.S. Cl. ..... 4/251; 4/248

[58] Field of Search ..... 4/251, 248, 236, 240; 220/246; 16/DIG. 2, 49, 65, 221; 49/324, 339, 347

[56] References Cited

U.S. PATENT DOCUMENTS

| | | | |
|---|---|---|---|
| 4,491,989 | 1/1985 | McGrail | 4/251 |
| 4,766,619 | 8/1980 | Takeda | 4/251 |
| 4,912,783 | 4/1990 | Shafer | 4/251 |
| 4,914,757 | 4/1990 | Johnson | 4/251 |

*Primary Examiner*—Henry J. Recla
*Assistant Examiner*—David J. Walczak
*Attorney, Agent, or Firm*—Terry M. Gernstein

[57] ABSTRACT

A water closet cover or seat is automatically pushed out of an upright, open condition when a flush handle of that water cloest is operated to flush the water closet. The cover or seat is moved under the influence of a torsion spring and under the influence of gravity towards a bowl covering position, with a shock absorber exerting retarding force on the cover or seat to prevent that cover or seat from slamming against the rim of the bowl. The shock absorber is connected to a shaft of a hinge unit connecting the cover or seat to the bowl by a direct connection or by cam and cam follower.

12 Claims, 4 Drawing Sheets

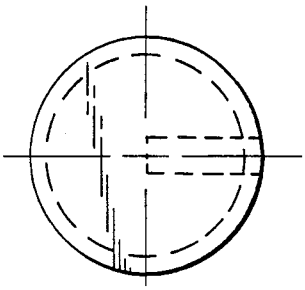
FIG. 10
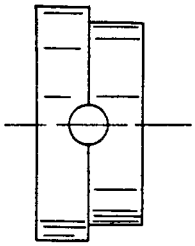
FIG. 11
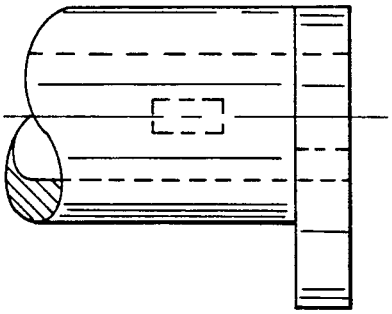
FIG. 12
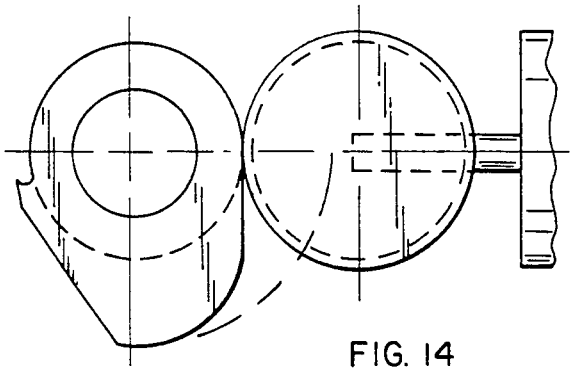
FIG. 14
FIG. 13
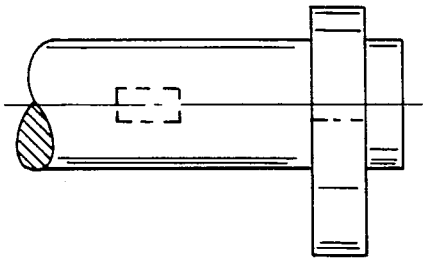
FIG. 15
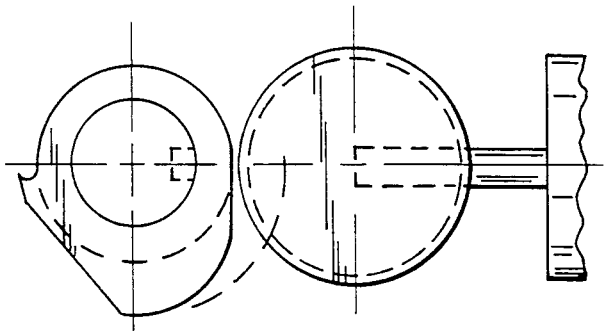
FIG. 16
FIG. 17

ASSEMBLY FOR AUTOMATICALLY CLOSING A WATER CLOSET COVER IN A CONTROLLED MANNER

TECHNICAL FIELD OF THE INVENTION

The present invention relates to the general art of bathroom accessories, and to the particular field of water closets.

BACKGROUND OF THE INVENTION

One complaint associated with a water closet that is common with both men and women concerns the toilet bowl cover. After using the water closet, many people, especially men, often forget to place the toilet bowl cover in the bowl covering position. Leaving the bowl uncovered presents problems which are both aesthetic and sanitary, and can even present a danger if small pets or children can be in the vicinity of the open toilet bowl.

Therefore, the art has included devices which are intended to ensure that the bowl cover is closed when the water closet is not in use. These devices range from simple cover latches which hold the cover in an upright orientation, to foot-operated pedals which lift the cover when the pedal is depressed.

While somewhat effective, the devices known prior to the device of the present invention suffer from several disadvantages. One disadvantage is the possibility that the cover may be accidentally dropped from the upright orientation. This is especially a problem with the detent devices, but also occurs in many of the other known devices. Dropping the cover may damage either the cover or the bowl.

Another disadvantage is the requirement for positive action by a user. The latching devices require a user to hook an element to the cover, then to unhook such cover, the foot pedals require the user to depress a foot pedal, and so forth. Such action may be bothersome to some users or even onerous to some users, who will simply omit such step and leave the cover open.

Therefore, there is a need for an assembly which will automatically lower a toilet bowl cover in a controlled manner from an upright bowl-uncovering orientation to a bowl-covering position without requiring any positive action from the water closet user which is additional to the actions commonly associated with use of a water closet.

OBJECTS OF THE INVENTION

It is a main object of the present invention is to provide an assembly which will automatically lower a toilet bowl cover in a controlled manner from an upright bowl-uncovering orientation to a bowl-covering position.

It is another object of the present invention to provide an assembly which will automatically lower a toilet bowl cover in a controlled manner from an upright bowl-uncovering orientation to a bowl-covering position without requiring any positive action from the water closet user which is additional to the actions commonly associated with use of a water closet.

SUMMARY OF THE INVENTION

These, and other, objects are achieved by an assembly which automatically moves a toilet bowl cover away from an upright, bowl-uncovering orientation towards a bowl closing-orientation upon actuation of the toilet flush handle, and then controls and retards movement of the bowl-covering movement of that cover.

The assembly includes a torsion spring on a hinge shaft which connects the toilet bowl cover to the bowl, and a shock absorber mounted on the mount that supports the hinge. The torsion spring and the shock absorber work in opposition to each other to control closing movement of the cover, which is gravity assisted as well. A cover pushing unit is attached to the toilet flush handle to be activated when the flush handle is operated to flush the toilet. Upon activation, the pushing unit pushes the bowl cover out of an upright orientation toward a bowl-closing orientation, which can be horizontal. The pushing unit pushes the cover far enough away from the vertical so that gravity produces enough force on the cover so that the gravity force in combination with the biasing force from the torsion spring draws that cover downwardly against the retarding force of the shock absorber.

The torsion spring and the shock absorber spring are selected to co-operate to lower the cover without permitting that cover to slam against the rim of the bowl. These springs can even be selected to hold the cover slightly above the rim if suitable.

In this manner, the cover will be automatically closed upon actuation of the toilet flush handle so that no postive action is required from the user which is additional to those action commonly associated with using the toilet, and the cover will not be subject to being slammed closed due to a user accidentally dropping the cover.

BRIEF DESCRIPTION OF THE DRAWING FIGURES

FIG. 10 is a front elevational view of a cam follower used in the alternative form of the cover or seat contacting assembly.

FIG. 11 is a side elevational view of a cam follower used in the alternative form of the cover or seat contacting assembly.

FIG. 12 is a side elevational view of a cam and cam shaft for a cover lifting portion of the assembly.

FIG. 13 is a front elevational view of the FIG. 12 cam and cam shaft.

FIG. 14 is an end elevational view of the FIG. 12 cam and cam shaft.

FIG. 15 is a side elevational view of a cam and cam shaft for a seat lifting portion of the assembly.

FIG. 16 is a front elevational view of the FIG. 15 cam and cam shaft.

FIG. 17 is an end elevational view of the FIG. 15 cam and cam shaft.

DETAILED DESCRIPTION OF THE PREFERRED EMBODIMENT OF THE INVENTION

Figure 1:
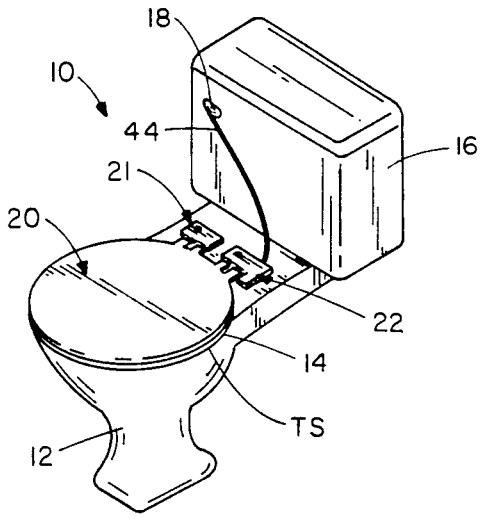
FIG. 1 is a perspective view of a water closet which includes the automatic bowl cover lowering assembly embodying the present invention.

Shown in FIG. 1 is a water closet 10 which includes a toilet bowl 12 mounted on a surface, such as a floor, which has an upper rim 14, and which contains the water used to operate the water closet. The water is moved into the bowl from a tank 16 mounted on the bowl near a rear end of that bowl upon operation of a flush handle 18 pivotally mounted on the tank 16.

A toilet bowl cover 20 is pivotally attached to the bowl by a hinge unit that includes a first shaft mount 21 that is affixed to the bowl in front of the tank and has a first shaft rotatably mounted therein. The first shaft is cylindrical in shape and rotates about a longitudinal axis thereof which is oriented to be essentially parallel to a plane containing the bowl rim 14.

Figure 2:
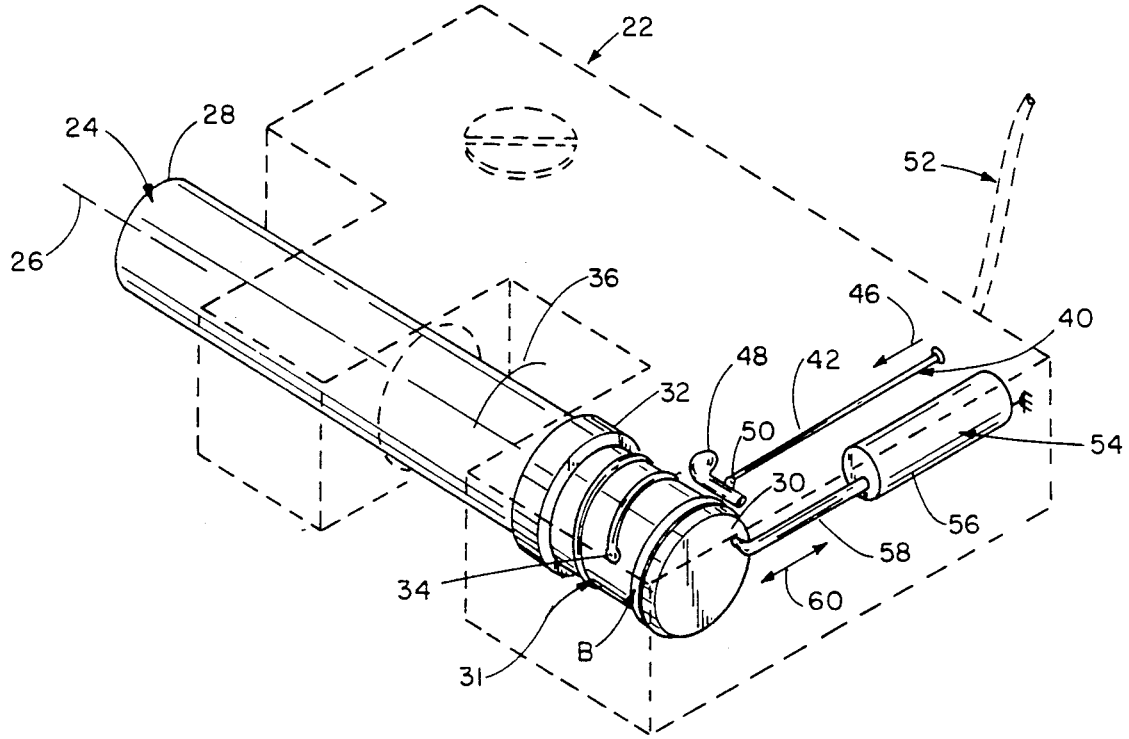
FIG. 2 is a perspective of the portion of the assembly that contacts the toilet bowl cover or seat in which a shock absorber is connected directly to the shaft of a hinge connecting that cover to the bowl.

A second shaft mount 22 is also affixed to the bowl in front of the tank 16 and is spaced from the first shaft mount. The second shaft mount 22 is also shown in FIG. 2 to have a second cylindrical shaft 24 rotatably mounted therein. The second shaft 24 includes a longitudinal centerline 26 extending between first end 28 and second end 30 and which is aligned with the longitudinal axis of the first shaft, with the first and second shafts and shaft mounts being identical other than the second shaft and second shaft mount being modified as will appear from the ensuing discussion.

The toilet bowl cover 20 is attached to the first and second shafts for rotation therewith from an upright bowl-uncovering position to a bowl covering position as shown in FIG. 1. The bowl covering position can be horizontal if suitable.

As discussed above, the toilet bowl cover is subject to being left in the upright condition, and is also subject to being slammed against the rim 14 if accidentally dropped. As was also discussed above, if positive action is required of the user that is additional to that action generally associated with the flushing of a toilet to close the cover, that cover may not be closed. Accordingly, the present invention is embodied in a mechanism for automatically lowering the toilet bowl cover 20 from the upright bowl-uncovering orientation into the bowl covering position shown in FIG. 1 while controlling such movement so that the cover is not likely to slam against the rim 14.

A first form of the mechanism is shown in FIG. 2 to include a torsion spring 31 that is wrapped around the second shaft 24 near the second end 30 of that shaft. The spring is attached at one end 32 thereof to the shaft and at the other end 34 thereof to the mount 22, and is biased to assist movement of the shaft in the direction indicated by the arrow 36. This movement will hereinafter be referred to as the cover forward or cover closing movement, and is assisted by the operation of gravity forces on the cover 20.

The cover 20 is connected to the shafts to be beyond vertical and to lean toward the tank when it is in the fully open condition, and the spring force associated with the spring 31 is adjusted so that when the cover 20 is in this fully open condition, the force of gravity on the cover will prevent the spring 31 from moving that cover forward. Thus, once fully open, the cover will not tend to move forward toward the closed position.

In order to move the cover beyond vertical on the opposite side of vertical, that is at an acute angle as measured between the rim 14 and the cover, the mechanism includes a cover pushing unit 40. The pushing unit pushes the cover from the obtuse angle of the fully open orientation to and past the vertical orientation so that gravity will assist the spring 31 in forcing the cover forward toward the closed condition. This pushing unit includes a trip wire 42 connected at a top end 44 thereof to the flush handle 18 to be driven in the direction indicated by arrow 46, which will be referred to as a trip wire forward direction, when the handle 18 is operated to flush the water closet. A pusher bar 48 is attached to the trip wire at a bottom end 50 of that trip wire to contact a shaftmounted bushing B in a manner that urges shaft 24 in direction 36. The trip wire is long enough so that the movement of the wire associated with operation of the flush handle is sufficient to move the cover out of the fully open condition to and past the perpendicular orientation under the influence of the pusher bar. Once the cover is past the perpendicular, the influence of gravity and the bias of the spring 31 will take over. The pusher bar 48 rides on a bushing B mounted on the shaft 24.

The trip wire is located in a sleeve 52, and a hole 54 is defined through the shaft mount 22. The shaft mount serves as a trip wire mount to orient the trip wire in a horizontal plane so that movement in the trip wire forward direction will move the toilet cover forward.

The mechanism also includes a cover movement controlling unit which retards forward movement of the toilet cover and thus acts in opposition to the bias of the spring 31 and the bias associated with the force of gravity on the cover.

The cover movement controlling unit includes a shock absorber 54 that is mounted on the shaft mount 22 and includes a case 56 which contains a compression spring that has one end thereof in abutting contact with the case, and is thus affixed to the shaft mount, and has a second end attached to an arm 58 which extends out of the case. Movement of the shock absorber arm 58 is in the directions indicated by the double-headed arrow 60.

In the first embodiment of the mechanism, the shock absorber arm is connected directly to the shaft 24 at the end 30, at a location spaced from the longitudinal centerline 26 so that there is a moment arm defined between the axis of rotation and the shock absorber arm. The spring in the shock absorber is biased and has a spring constant such that the spring exerts enough force on the shaft via the moment arm to resist the forward force on that cover from the spring 31 and the force of gravity. The shock absorber spring thus exerts a retarding force in a direction opposite to direction 46 as the cover moves in the forward direction indicated by arrow 36. This retarding force is selected so that the cover moves slowly into the bowl covering position shown in FIG. 1 without slamming against the rim 14.

Figure 3:
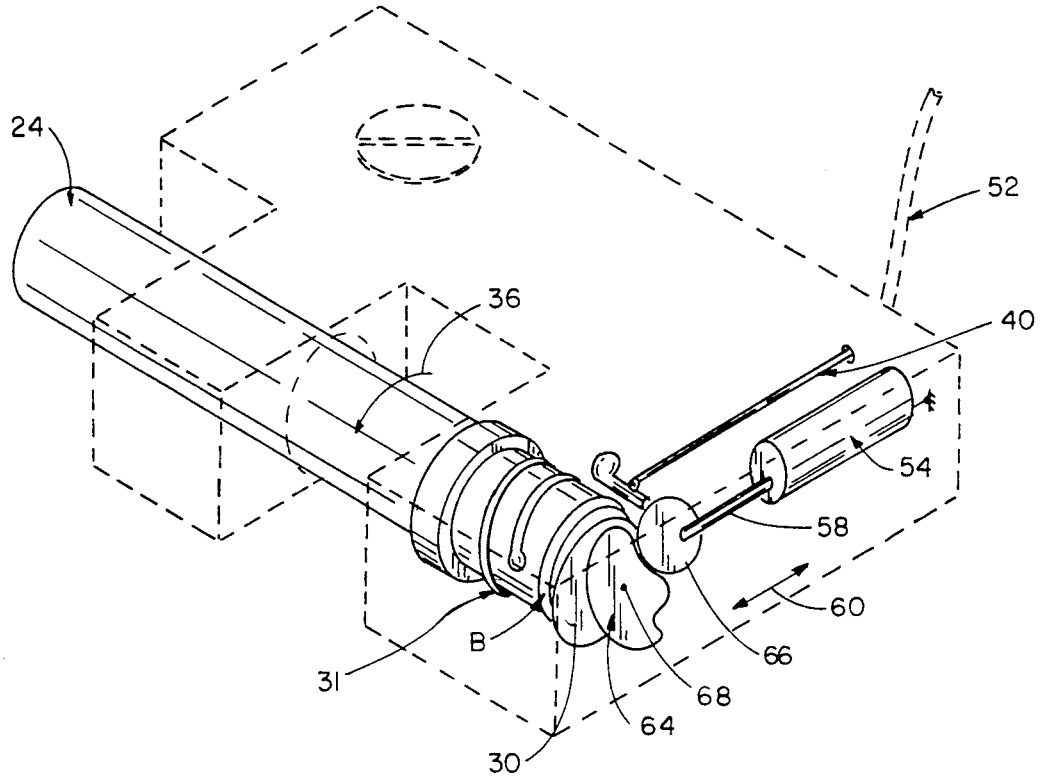
FIG. 3 is a perspective of the portion of the assembly that contacts the toilet bowl cover in which a cam connects the shaft of a hinge connecting that cover to the bowl to the shock absorber via a follower.
Figure 4:
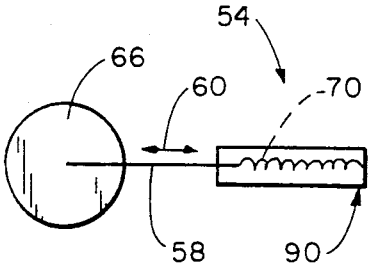
FIG. 4 is a side elevational view of a cam follower and shock absorber.

A second embodiment of the mechanism is shown in FIG. 3 as including a cam 64 mounted on the shaft 24 at the end 30 and which engages a circular cam follower 66 rotatably mounted at the center thereof on the end of the shock absorber arm 58 by a yoke or the like. The cam 64 rotates in the forward direction 36 as above discussed about a center of rotation 68, and the cam follower moves in the directions 60 under the influence of the shock absorber spring 70 via the arm 58 as is shown in FIG. 4.

Figure 5:
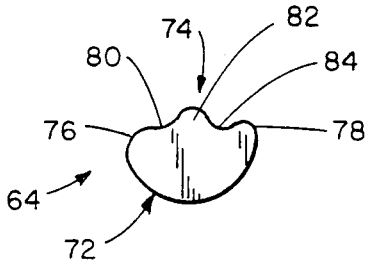
FIG. 5 is a cam which is mounted on the shaft of the toilet bowl cover mounting hinge.

As best shown in FIG. 5, the cam includes a first arcuate surface 72 connected to a second arcuate surface 74 at edge 76 and ridge 78. The surface 74 is concavo-convex and includes a first concave surface section 80 extending from edge 76, a convex surface section 82 extending from section 80, and a second concave surface section 84 connecting the convex section 82 to the ridge 78. The ridge 78 is sharper than the edge 76 for a purpose that will be evident from the ensuing discussion.

Figure 6:
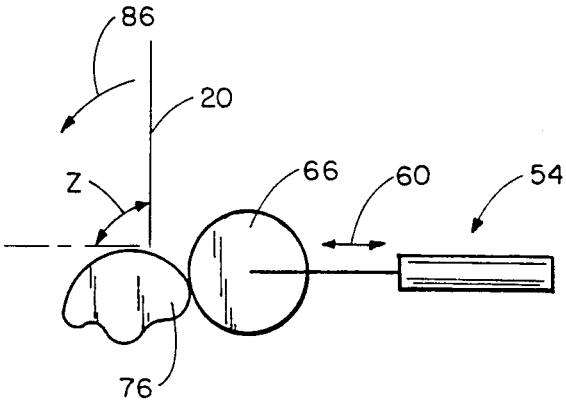
FIGS. 6–8 illustrate the relative positions and orientations of the cam and the cam follower as the toilet cover moves into the bowl-covering position from an upright orientation.
Figure 7:
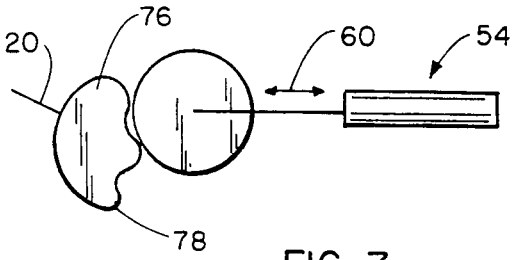
Figure 8:
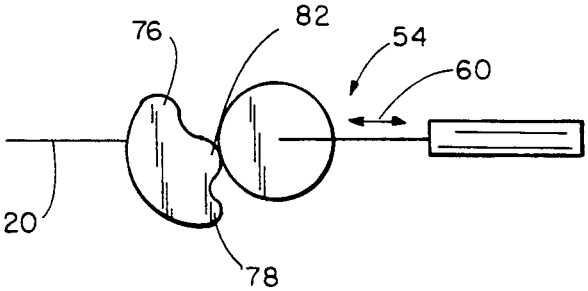

Referring to FIGS. 6–8, the action of the second embodiment will be explained. The cover is shown in FIG. 6 in the fully open condition with an angle Z between the cover and the horizontal being oblique, that is greater than ninety degrees. The edge 76 of the cam 64 abuts the circular cam follower 66. As the pushing unit forces the cover forward past the perpendicular, the edge rolls past the point of contact between the cam and the cam follower, and the first concave surface section 80 contacts the cam follower. The contact between this surface section and the cam follower permits the cover 20 continue forward movement as indicated by arrow 86, but in a controlled and retarded manner. As the cover nears the horizontal orientation, the concave surface becomes sharply convex at section 82 thereby increasing the retarding force exerted on the cover against movement in the direction 86. The convex surface section 82 forces the cam follower back towards the shock absorber case against the force of the spring, and this spring force is selected to stop the further forward motion of the cover 20. The cover 20 can be stopped in any suitable position, but a position just short of horizontal is preferred as shown in FIG. 8 so that the cover does not slam against the bowl rim 14. Should the cam accidentally rotate past the FIG. 8 position, the ridge 78 will abut the cam follower and stop further downward movement of the cover. The location of the ridge on the cam is selected to stop the further downward movement prior to the cover reaching a position in which it is likely to slam against the bowl rim 14.

The shock absorber is pivotally mounted to the second shaft mount at end 90 so that shock absorber can move to accommodate the above-discussed movements for both embodiments.

Although the mechanism has been disclosed as controlling movement of the cover, it could also be used to begin and control movement of the toilet seat TS as shown in FIG. 1 as well without departing from the scope of the present disclosure.

Figure 9:
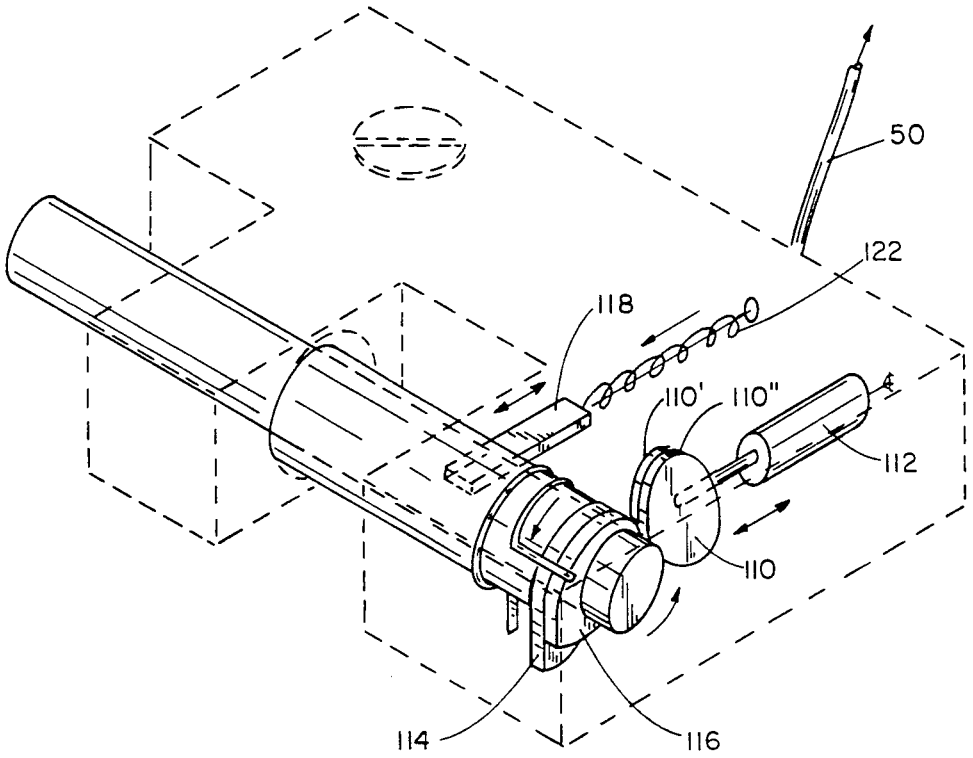
FIG. 9 is a perspective of an alternative form of the portion of the assembly that contacts the toilet bowl cover or seat in which a shock absorber is connected directly to the shaft of a hinge connecting that cover to the bowl.

Other forms of the cam follower and cam shaft are shown in FIGS. 9–17. The cam and cam follower mechanism shown in FIGS. 12, 13 and 14 is suitable for use in moving a cover; whereas the cam and cam follower mechanism shown in FIGS. 14, 15 and 16 is suitable for use in moving a seat. The operation of these cam and cam follower mechanisms is the same as above discussed, and thus will not be discussed. The device shown in FIG. 9 is identical in operation to the devices discussed above and has an oval cam follower 110 on a shock absorber element 112 and in abutting engagement with a cover cam 114 and with a seat cam 116. The cam follower 110 has two different surfaces 110' and 110'', which engage the cams 114 and 116 respectively. A locking pin 118 is biased into locking engagement with the element 120 by a spring 122 and the cable 50 is used to operate the device shown in FIG. 9 in the manner discussed above. The device shown in FIG. 9 thus operates both a seat and a cover in a manner discussed above.

It is understood that while certain forms of the present invention have been illustrated and described herein, it is not to be limited to the specific forms or arrangements of parts described and shown.

I claim:

1. An assembly for automatically lowering a toilet bowl cover in a controlled manner comprising:

A) a toilet bowl having a rim, a forward location and a tank mounted thereon at a rear location on said bowl;

B) a toilet flush system which includes a flush handle mounted on said tank;

C) a hinge unit mounted on said toilet bowl adjacent to said tank and including (1) a first shaft mount having a first shaft rotatably mounted therein, said first shaft being cylindrical and having a longitudinal axis extending parallel to a plane containing said toilet bowl rim and rotating about said longitudinal axis, (2) a second shaft mount having a second shaft rotatably mounted therein, said second shaft being cylindrical and having first and second ends and a longitudinal centerline which is aligned with said first shaft longitudinal axis, said second shaft rotating about said second shaft longitudinal centerline;

D) a toilet bowl cover fixed to said first and second shafts for movement therewith between an upright bowl uncovering position and a bowl covering position; and E) a mechanism for automatically lowering said toilet bowl cover from said bowl uncovering position to said bowl covering position and for controlling and retarding such movement as said cover moves, said mechanism including (1) a torsion spring on said second shaft near said second shaft one end, said torsion spring being fixed to said second shaft at one end of said spring and being fixed to said second shaft mount at another end of said spring and applying force to said second shaft to bias said second shaft to rotate in a forward direction which moves said cover from said bowl uncovering position towards said bowl covering position, (2) a cover pushing unit which includes (a) a trip wire connected at a top end thereof to said toilet flush handle to move when said flush handle is operated to flush said toilet, (b) a pusher bar attached to said trip wire at a bottom end of said trip wire for movement therewith, said pusher bar being located to be in abutting contact with said second shaft when said cover is in said upright bowl uncovering position, (c) a trip wire mount which orients said pusher bar and said trip wire to move in a trip wire forward direction towards said cover and to force cover forward when said flush handle is operated to flush said toilet with said abutting contact between said pusher bar and said toilet bowl second shaft causing said cover to move out of said upright position towards said bowl covering position when said flush handle is operated to flush said toilet, and (3) a cover movement controlling unit for controlling and retarding forward movement of said cover from said upright position toward said bowl covering position, said cover movement controlling unit including (a) a spring-loaded shock absorber mounted on said second shaft mount and including a shock absorber arm connected to said second shaft, (b) a spring in said shock absorber and connected to said shock absorber arm, said shock absorber spring acting in opposition to said torsion spring and in opposition to the force gravity exerts on said cover to control and retard forward movement of said toilet bowl cover from said upright position towards said bowl covering position.

2. The assembly defined in claim 1 wherein said cover movement controlling unit further includes (c) a cam mounted on said second shaft for rotation therewith, and (d) a cam follower mounted on said shock absorber arm to engage said cam as said cam rotates.

3. The assembly defined in claim 2 wherein said cam includes a first arcuate surface and a concavo-convex surface in engagement with said cam follower.

4. The assembly defined in claim 3 wherein said concavo-convex surface includes a convex section located between two concave sections.

5. The assembly defined in claim 4 wherein said cam further includes an edge connected to a first section of said two concave sections and a ridge connected to a second section of said two concave sections.

6. The assembly defined in claim 5 wherein said ridge and said edge have radii of curvature, with said ridge having a greater radius of curvature than said edge.

7. The assembly defined in claim 6 wherein said cam follower is circular in peripheral shape and is mounted at the center thereof.

8. The assembly defined in claim 1 wherein said shock absorber arm is connected to said second shaft at a location spaced from said longitudinal centerline, and said shock absorber is pivotally mounted on said second shaft mount.

9. The assembly defined in claim 7 further including a bushing on said second shaft on which said pusher bar rides.

10. The assembly defined in claim 9 further including a sleeve containing said trip wire.

11. An assembly for automatically lowering a toilet bowl seat in a controlled manner comprising:

A) a toilet bowl having a rim, a forward location and a tank mounted thereon at a rear location on said bowl;

B) a toilet flush system which includes a flush handle mounted on said tank;

C) a hinge unit mounted on said toilet bowl adjacent to said tank and including (1) a first shaft mount having a first shaft rotatably mounted therein, said first shaft being cylindrical and having a longitudinal axis extending parallel to a plane containing said toilet bowl rim and rotating about said longitudinal axis, (2) a second shaft mount having a second shaft rotatably mounted therein, said second shaft being cylindrical and having first and second ends and a longitudinal centerline which is aligned with said first shaft longitudinal axis, said second shaft rotating about said second shaft longitudinal centerline;

D) a toilet bowl seat fixed to said first and second shafts for movement therewith between an upright bowl uncovering position and a bowl covering position; and E) a mechanism for automatically lowering said toilet bowl seat from said bowl uncovering position to said bowl covering position and for controlling and retarding such movement as said seat moves, said mechanism including (1) a torsion spring on said second shaft near said second shaft one end, said torsion spring being fixed to said second shaft at one end of said spring and being fixed to said second shaft mount at another end of said spring and applying force to said second shaft to bias said second shaft to rotate in a forward direction which moves said seat from said bowl uncovering position towards said bowl covering position, (2) a seat pushing unit which includes (a) a trip wire connected at a top end thereof to said toilet flush handle to move when said flush handle is operated to flush said toilet, (b) a pusher bar attached to said trip wire at a bottom end of said trip wire for movement therewith, said pusher bar being located to be in abutting contact with said second shaft when said seat is in said upright bowl uncovering position, (c) a trip wire mount which orients said pusher bar and said trip wire to move in a trip wire forward direction towards said seat and to force seat forward when said flush handle is operated to flush said toilet with said abutting contact between said pusher bar and said second shaft causing said seat to move out of said upright position towards said bowl covering position when said flush handle is operated to flush said toilet, and (3) a seat movement controlling unit for controlling and retarding forward movement of said seat from said upright position toward said bowl covering position, said seat movement controlling unit including (a) a spring-loaded shock absorber mounted on said second shaft mount and including a shock absorber arm connected to said second shaft, (b) a spring in said shock absorber and connected to said shock absorber arm, said shock absorber spring acting in opposition to said torsion spring and in opposition to the force gravity exerts on said seat to control and retard forward movement of said toilet bowl seat from said upright position towards said bowl covering position.

12. An assembly for use with a toilet comprising:

A) a toilet bowl having a rim, a forward location and a tank mounted thereon at a rear location on said bowl;

B) a toilet flush system which includes a flush handle mounted on said tank;

C) a hinge unit mounted on said toilet bowl adjacent to said tank and including (1) a first shaft mount having a first shaft rotatably mounted therein, said first shaft being cylindrical and having a longitudinal axis extending parallel to a plane containing said toilet bowl rim and rotating about said longitudinal axis, (2) a second shaft mount having a second shaft rotatably mounted therein, said second shaft being cylindrical and having first and second ends and a longitudinal centerline which is aligned with said first shaft longitudinal axis, said second shaft rotating about said second shaft longitudinal centerline;

D) a toilet bowl seat fixed to said first and second shafts for movement therewith between an upright bowl uncovering position and a bowl covering position;

E) a toilet bowl cover fixed to said first and second shafts for movement therewith between an upright bowl uncovering position and a bowl covering position F) a mechanism for automatically lowering said toilet bowl seat and said toilet bowl cover from said bowl uncovering positions to said bowl covering positions and for controlling and retarding such movement as said seat and said cover move, said mechanism including (1) a torsion spring on said second shaft near said second shaft one end, said torsion spring being fixed to said second shaft at one end of said spring and being fixed to said second shaft mount at another end of said spring and applying force to said second shaft to bias said second shaft to rotate in a forward direction which moves said seat from said bowl uncovering position towards said bowl covering position, (2) a seat and cover pushing unit which includes (a) a trip wire connected at a top end thereof to said toilet flush handle to move when said flush handle is operated to flush said toilet, (b) a pusher bar attached to said trip wire at a bottom end of said trip wire for movement therewith, said pusher bar being located to be in abutting contact with said second shaft when said seat and said cover are in said upright bowl uncovering positions, (c) a trip wire mount which orients said pusher bar and said trip wire to move in a trip wire forward direction towards said seat and said cover and to force seat and said cover forward when said flush handle is operated to flush said toilet with said abutting contact between said pusher bar and said second shaft causing said cover and seat to move out of said upright positions towards said bowl covering positions when said flush handle is operated to flush said toilet, and (3) a cover and seat movement controlling unit for controlling and retarding forward movements of said cover and said seat from said upright position toward said bowl covering position, said cover and seat movements controlling unit including (a) a spring-loaded shock absorber mounted on said second shaft mount and including a shock absorber arm connected to said second shaft, (b) a spring in said shock absorber and connected to said shock absorber arm, said shock absorber spring acting in opposition to said torsion spring and in opposition to the force gravity exerts on said cover and seat to control and retard forward movements of said toilet bowl cover and seat from said upright positions towards said bowl covering positions.

* * * * *